US011382183B2

(12) United States Patent
Rossoll et al.

(10) Patent No.: US 11,382,183 B2
(45) Date of Patent: Jul. 5, 2022

(54) MULTI-LAYER SUSCEPTOR ASSEMBLY FOR INDUCTIVELY HEATING AN AEROSOL-FORMING SUBSTRATE

(71) Applicant: PHILIP MORRIS PRODUCTS S.A., Neuchatel (CH)

(72) Inventors: Andreas Michael Rossoll, Mont-sur-Lausanne (CH); Oleg Fursa, Gempenach (CH)

(73) Assignee: Philip Morris Products S.A., Neuchatel (CH)

( * ) Notice: Subject to any disclaimer, the term of this patent is extended or adjusted under 35 U.S.C. 154(b) by 324 days.

(21) Appl. No.: 16/495,198

(22) PCT Filed: Mar. 29, 2018

(86) PCT No.: PCT/EP2018/058041
§ 371 (c)(1),
(2) Date: Sep. 18, 2019

(87) PCT Pub. No.: WO2018/178218
PCT Pub. Date: Oct. 4, 2018

(65) Prior Publication Data

US 2020/0138105 A1 May 7, 2020

(30) Foreign Application Priority Data

Mar. 31, 2017 (EP) ..... 17164357

(51) Int. Cl.
*A24F 13/00* (2006.01)
*H05B 6/06* (2006.01)
(Continued)

(52) U.S. Cl.
CPC ..... *H05B 6/06* (2013.01); *A24D 1/20* (2020.01); *H05B 6/108* (2013.01); *A24F 40/20* (2020.01);
(Continued)

(58) Field of Classification Search
CPC ..... A24F 47/00
(Continued)

(56) References Cited

U.S. PATENT DOCUMENTS 4,309,489 A 1/1982 Momose
5,427,846 A 6/1995 McGaffigan
(Continued)

FOREIGN PATENT DOCUMENTS

CN 1498059 5/2004
CN 101045356 10/2007
(Continued)

OTHER PUBLICATIONS

PCT Search Report and Written Opinion for PCT/EP2018/058041 dated July 2, 2018 (13 pages).
(Continued)

*Primary Examiner* — Phuong K Dinh
(74) *Attorney, Agent, or Firm* — Mueting Raasch Group

(57) ABSTRACT

The present invention relates to a multi-layer susceptor assembly for inductively heating an aerosol-forming substrate which comprises at least a first layer and a second layer intimately coupled to the first layer. The first layer comprises a first susceptor material. The second layer comprises a second susceptor material having a Curie temperature lower than 500° C. The susceptor assembly further comprises a third layer intimately coupled to the second layer which comprises a specific stress-compensating material and a specific layer thickness such that after a processing of the multi-layer susceptor assembly the third layer exerts a tensile or compressive stress onto the second layer at least in a compensation temperature range for counteracting a compressive or tensile stress exerted by the first layer onto the second layer. The compensation temperature range extends at least from 20 K below the Curie temperature of
(Continued)

the second susceptor material up to the Curie temperature of the second susceptor material.

15 Claims, 2 Drawing Sheets

(51) Int. Cl.
*H05B 6/10* (2006.01)
*A24D 1/20* (2020.01)
*A24F 40/465* (2020.01)
*A24F 40/20* (2020.01)

(52) U.S. Cl.
CPC ..... *A24F 40/465* (2020.01); *H05B 2206/02* (2013.01)

(58) Field of Classification Search
USPC ..... 131/328–329
See application file for complete search history.

(56) References Cited

U.S. PATENT DOCUMENTS

| | | | | |
|---|---|---|---|---|
| 2008/0128078 | A1 | 6/2008 | May | |
| 2020/0323271 | A1* | 10/2020 | Alizon | A24B 15/10 |
| 2021/0219616 | A1* | 7/2021 | Crump | A24F 40/42 |
| 2021/0251287 | A1* | 8/2021 | Emmett | A24F 40/42 |
| 2021/0329748 | A1* | 10/2021 | Taurino | A24F 40/42 |

FOREIGN PATENT DOCUMENTS

| | | |
|---|---|---|
| CN | 101740694 | 6/2010 |
| CN | 105407750 | 3/2016 |
| DE | 10257290 | 6/2004 |
| EA | 19736 B1 | 5/2014 |
| EA | 22838 B1 | 3/2016 |
| EP | 3248485 | 4/2020 |
| WO | WO 82/03305 | 9/1982 |
| WO | WO 2015/176898 | 11/2015 |
| WO | WO 2015/177045 | 11/2015 |
| WO | WO 2015/177263 | 11/2015 |
| WO | WO 2015/177265 | 11/2015 |
| WO | WO 2015/177294 | 11/2015 |
| WO | WO 2016/184928 | 11/2016 |

OTHER PUBLICATIONS

Office Action issued in Russia for Application No. 2019134771/03 dated Jul. 29, 2021 (12 pages). English translation included.
Office Action issued in China for Application No. 201880021337.7 dated Dec. 9, 2021 (18 pages). English translation included.

* cited by examiner

MULTI-LAYER SUSCEPTOR ASSEMBLY FOR INDUCTIVELY HEATING AN AEROSOL-FORMING SUBSTRATE

This application is a U.S. National Stage Application of International Application No. PCT/EP2018/058041 filed Mar. 29, 2018, which was published in English on Oct. 4, 2018, as International Publication No. WO 2018/178218 A1. International Application No. PCT/EP2018/058041 claims priority to European Application No. 17164357.0 filed Mar. 31, 2017.

FIELD

The present invention relates to a multi-layer susceptor assembly for inductively heating an aerosol-forming substrate as well as to an aerosol-generating article including such a multi-layer susceptor assembly and an aerosol-forming substrate to be heated.

INTRODUCTION

Aerosol-generating articles, which include an aerosol-forming substrate to form an inhalable aerosol upon heating, are generally known from prior art. For heating the substrate, the aerosol-generating article may be received within an aerosol-generating device comprising an electrical heater. The heater may be an inductive heater comprising an induction source. The induction source generates an alternating electromagnetic field that induces heat generating eddy currents and/or hysteresis losses in a susceptor. The susceptor itself is in thermal proximity of the aerosol-forming substrate to be heated. In particular, the susceptor may be integrated in the article in direct physical contact with the aerosol-forming substrate.

For controlling the temperature of the substrate, bi-layer susceptor assemblies have been proposed comprising a first and a second layer made of a first and a second susceptor material, respectively. The first susceptor material is optimized with regard to heat loss and thus heating efficiency. In contrast, the second susceptor material is used as temperature marker. For this, the second susceptor material is chosen such as to have a Curie temperature lower than a Curie temperature of the first susceptor material, but corresponding to a predefined heating temperature of the susceptor assembly. At its Curie temperature, the magnetic permeability of the second susceptor drops to unity leading to a change of its magnetic properties from ferromagnetic to paramagnetic, accompanied by a temporary change of its electrical resistance. Thus, by monitoring a corresponding change of the electrical current absorbed by the induction source it can be detected when the second susceptor material has reached its Curie temperature and, thus, when the predefined heating temperature has been reached.

The desired properties of the susceptor materials are typically chosen with regard to the individual materials in a non-assembled situation. However, when assembling the first and second susceptor materials to each other to form a bi-layer susceptor assembly, the specific properties of the layers, in particular the magnetic properties may change as compared to the non-assembled state. In many cases, it has been observed that joining the layers and further processing the assembly may even impair the originally desired properties and effects of the layer materials.

Therefore, it would be desirable to have a multi-layer susceptor assembly for inductively heating an aerosol-forming substrate with the advantages of prior art solutions but without their limitations. In particular, it would be desirable to have a multi-layer susceptor assembly providing specific layer properties and effects which are tailored in due consideration of the conjoined nature of the assembly and its processing.

SUMMARY

According to the invention there is provided a multi-layer susceptor assembly for inductively heating an aerosol-forming substrate which comprises at least a first layer and a second layer intimately coupled to the first layer. The first layer comprises a first susceptor material. The second layer comprises a second susceptor material having a Curie temperature lower than 500° C. (degree Celsius).

DETAILED DESCRIPTION

Preferably the first susceptor material is configured for inductively heating the aerosol-forming substrate and the second susceptor material is configured for monitoring a temperature of the susceptor assembly. For this, the Curie temperature of the second susceptor material preferably corresponds to a predefined heating temperature of the susceptor assembly.

As used herein, the term 'intimately coupled' refers to a mechanical coupling between two layers within the multi-layer assembly such that a mechanical force may be transmitted between the two layers, in particular in a direction parallel to the layer structure. The coupling may be a laminar, two-dimensional, areal or full-area coupling, that is, a coupling across the respective opposing surfaces of the two layers. The coupling may be direct. In particular, the two layers, which are intimately coupled with each other, may be in direct contact with each other. Alternatively, the coupling may be indirect. In particular, the two layers may be indirectly coupled via at least one intermediate layer.

Preferably, the second layer is arranged upon and intimately coupled to, in particular directly connected with the first layer.

According to the invention, it has been recognized that the processing of a susceptor assembly comprising multiple layers intimately coupled to each other may cause one layer to exert a compressive or tensile stress onto another layer. This may be due to specific differences between the thermal expansion of the various layer materials. For example, a processing of a bi-layer susceptor assembly as described above may comprise intimately connecting both layer materials to each other at a given temperature. Connecting the layers may be possibly followed by a heat treatment of the assembled susceptor, such as annealing. During a subsequent change of temperature, such as during a cooldown of the susceptor assembly, the individual layers cannot deform freely due to the conjoined nature of the assembly. Consequently, in case of the second layer having a coefficient of thermal expansion larger than that one of the first layer, a tensile stress state may develop in the second layer upon cooldown. This tensile stress state in turn may affect the magnetic susceptibility of the second susceptor material due to magnetostriction. In case of a second susceptor material having a negative coefficient of magnetostriction, such as Ni (nickel), the magnetic susceptibility may thus be lowered. In particular in the relevant temperature range around the Curie temperature of the second susceptor material, a reduced magnetic susceptibility may cause a change of the skin layer depth and, thus, a temporary change of the resistance of the second susceptor material to be less pronounced. This in turn may undesirably impair the functionality of the second layer as temperature marker. Likewise, in case the second layer has a coefficient of thermal expansion smaller than that one of the first layer and a positive coefficient of magnetostriction, such as with numerous alloys in which Ni (nickel) and Fe (iron) are the principal constituents, the analogous disfavorable effect of a reduced susceptibility is observed.

To counter this, the susceptor assembly according to the present invention further comprises a third layer that is intimately coupled to the second layer. The third layer comprises a specific stress-compensating material and a specific layer thickness such that after a processing of the multi-layer susceptor assembly, in particular after intimately coupling the layers to each other and/or after a heat treatment of the multi-layer susceptor assembly, for example after a heat treatment, the third layer exerts a tensile or compressive stress onto the second layer at least in compensation temperature range. The compensation temperature range extends at least from 20 K below the Curie temperature of the second susceptor material up to the Curie temperature of the second susceptor material.

Thus, the tensile or compressive stress exerted by the third layer onto the second layer advantageously counteracts a compressive or tensile stress exerted by the first layer onto the second layer after processing. Accordingly, the third layer advantageously allows for preserving the originally desired properties and functionalities of the second layer, for example temperature marker function. In particular, the third layer advantageously allows for maintaining the magnetic susceptibility of the second susceptor material as if it was not integrated in the susceptor assembly. This in turn proves particularly advantageous for keeping a temporary change of the resistance of the second susceptor material in the susceptor assembly as pronounced as compared to the non-assembled situation.

As used herein, a processing of the multilayer susceptor assembly may comprise at least one of intimately coupling the layer materials to each other at a given temperature, or a heat treatment of the multilayer susceptor assembly, such as annealing. In particular, the susceptor assembly may be a heat treated susceptor assembly. In any cases, during a processing as referred to herein the temperature of the layers or the assembly, respectively, is different from the operating temperature of the susceptor assembly when being used for inductively heating an aerosol-forming substrate. Typically, the temperatures during intimately connecting the layer materials to each other and during a heat treatment of the multilayer susceptor assembly are larger than the operating temperatures of the susceptor assembly for inductive heating.

As an example, the first layer may comprise a ferritic stainless steel for inductively heating the aerosol-forming substrate and the second layer may comprise Ni (nickel) as temperature marker having a Curie temperature in the range of in the range of about 354° C. to 360° C. or 627 K to 633 K, respectively, depending on the nature of impurities. This Curie temperature is well suited for most applications as regards heating of an aerosol-forming substrate. For processing reasons, the susceptor assembly may be annealed. During a subsequent cooldown, the first layer may exert an undesired tensile stress onto the nickel due to the coefficient of thermal expansion being lower for ferritic stainless steel than for nickel. To counter the undesired tensile stress, a third layer is provided on top of the second layer—opposite of the first layer—having a stress-compensating material and a layer thickness specifically chosen such that upon cooldown of the assembly after the heat treatment the third layer exerts a counteracting compressive stress onto the nickel layer at least in a temperature range from 20 K below the Curie temperature of the nickel layer up to the Curie temperature of the nickel layer. Preferably, the third layer comprises an austenitic stainless steel which has a larger coefficient of thermal expansion than nickel.

The compensation temperature range from 20 K below the Curie temperature of the second susceptor material up to the Curie temperature of the second susceptor material corresponds to a typical range of operating temperatures of the susceptor assembly used for generating an aerosol.

Advantageously, the span of the compensation temperature range may be also larger than 20 K. Accordingly, the compensation temperature range may extend at least from 50 K, in particular 100 K, preferably 150 K below the Curie temperature of the second susceptor material up to the Curie temperature of the second susceptor material. Most preferably, the compensation temperature range may extend at least from ambient room temperature up to the second Curie temperature. Likewise, the compensation temperature range may correspond to a temperature range between 150° C. and the Curie temperature of the second susceptor material, in particular between 100° C. and the Curie temperature of the second susceptor material, preferably between 50° C. and the Curie temperature of the second susceptor material, most preferably between ambient room temperature and the Curie temperature of the second susceptor material.

When approaching the second Curie temperature from below, magnetization and therefore any magnetostriction effect in the second susceptor material disappear. Therefore, an upper limit of the compensation temperature range preferably corresponds to the Curie temperature of the second susceptor material. However, the upper limit of the compensation temperature range may be also higher than the Curie temperature of the second susceptor material. For example, an upper limit of the compensation temperature range may be at least 5 K, in particular at least 10 K, preferably at least 20K higher than the Curie temperature of the second susceptor material.

A coefficient of thermal expansion of the second susceptor material may be larger than a coefficient of thermal expansion of the first susceptor material and smaller than a coefficient of thermal expansion of the stress-compensating material. This configuration may prove advantageous especially in case the first, the second and the third layer are adjacent layers or at least arranged in said order.

In particular in this configuration but also in other configurations, the second susceptor material preferably may preferably have a negative coefficient of magnetostriction and the specific stress-compensating material. In this case, the specific layer thickness of the third layer preferably may be such that after the processing of the multi-layer susceptor assembly the third layer exerts a compressive stress onto the second layer causing the second layer to be in a net compressive stress state at least in the compensation temperature range.

Alternatively, a coefficient of thermal expansion of the second susceptor material may be smaller than a coefficient of thermal expansion of the first susceptor material and larger than a coefficient of thermal expansion of the stress-compensating material.

In particular in this configuration but also in other configurations, the second susceptor material preferably may preferably have a positive coefficient of magnetostriction. In this case, the specific stress-compensating material and the specific layer thickness of the third layer may be such that after the processing of the multi-layer susceptor assembly the third layer exerts a tensile stress onto the second layer causing the second layer to be in a net tensile stress state at least in the compensation temperature range.

Preferably, the third layer is configured not only to counteract but also to essentially compensate a compressive or tensile stress exerted by the first layer onto the second layer. Accordingly, the specific stress-compensating material and the specific layer thickness of the third layer may be such that after the processing of the multi-layer susceptor assembly the third layer exerts a tensile or compressive stress onto the second layer at least in the compensation temperature range for essentially compensating a compressive or tensile stress exerted by the first layer onto the second layer.

As described above, when the susceptor assembly reaches the Curie temperature of the second susceptor material, the magnetic properties of the second susceptor material change from ferromagnetic to paramagnetic. This change of the magnetic properties is accompanied by a temporary change of its electrical resistance which in turn may be used to detect when a predefined heating temperature of the susceptor assembly has been reached. According to a preferred aspect of the invention, the third layer may be configured to allow not only for preserving the temporary change of the resistance of the second susceptor material but also for enhancing a respective change of resistance. In this context, enhancing a change of the electrical resistance of the second susceptor material is to be understood in comparison to the non-assembled situation, that is, in comparison to the second layer not being coupled to any other layer. According to this preferred aspect of the invention, the specific stress-compensating material and the specific layer thickness of the third layer may be such that the third layer exerts a tensile or compressive stress onto the second layer after the processing of the multi-layer susceptor assembly for enhancing a change of an electrical resistance of the second susceptor material at least when the temperature of the susceptor reaches the Curie temperature of the second susceptor material. In particular, the change of resistance of the second susceptor material may be enhanced at least in the compensation temperature range. Alternatively, the change of resistance of the second susceptor material may be enhanced at least in a temperature range of at least ±5 K, preferably of at least ±10 K, even more preferably of at least ±20 K around the Curie temperature of the second susceptor material.

As described above, the change of resistance of the second susceptor material is closely related to the skin effect and thus to a change of the skin depth in the second susceptor material upon reaching its Curie temperature. Hence, according to a further aspect of the invention, the specific stress-compensating material and the specific layer thickness of the third layer may be such that the third layer exerts a tensile or compressive stress onto the second layer after the processing of the multi-layer susceptor assembly for enhancing a change of a skin depth of the second susceptor material at least when the temperature of the susceptor reaches the Curie temperature of the second susceptor material. In this context, enhancing a change of the skin depth of the second susceptor material is to be understood in comparison to the non-assembled situation, that is, in comparison to the second layer not being coupled to any other layer. In particular, the change of the skin depth of the second susceptor material may be enhanced at least in the compensation temperature range. Alternatively, the change of the skin depth of the second susceptor material may be enhanced at least in a temperature range of at least ±5 K, preferably of at least ±10 K, even more preferably of at least ±20 K around the Curie temperature of the second susceptor material.

According to the invention, the third layer is intimately coupled to the second layer. In this context, the term 'intimately coupled' is used in the same way as defined above with regard to the first and second layer.

As used herein, the terms 'first layer', 'second layer' and 'third layer' are only nominal without necessarily specifying a particular order or sequence of the respective layers.

Preferably, the third layer is arranged upon and intimately coupled to the second layer, which in turn may be arranged upon and intimately coupled to the first layer.

Alternatively, the third layer may be intimately coupled to the second layer via the first layer. In this case, the first layer may be an intermediate layer between the third layer and the second layer. In particular, the second layer may be arranged upon and intimately coupled to the first layer, which in turn may be arranged and intimately coupled to the first layer.

Preferably, the first layer, the second layer and the third layer are adjacent layers of the multilayer susceptor assembly. In this case, the first layer, the second layer and the third layer may be in direct intimate physical contact with each other. In particular, the second layer may be sandwiched between the first layer and the third layer.

Alternatively, the susceptor assembly may comprise at least one further layer, in particular at least one intermediate layer that is arranged between two respective ones of the first layer, the second layer and the third layer.

At least one of the first layer or the third layer may be an edge layer of the multilayer susceptor assembly.

With regard to the processing of the susceptor assembly, in particular with regard to assembling the various layers, each of the layers may be plated, deposited, coated, cladded or welded onto a respective adjacent layer. In particular, any of these layers may be applied onto a respective adjacent layer by spraying, dip coating, roll coating, electroplating or cladding. This holds in particular for the first layer, the second layer and the third layer and—if present—the at least one intermediate layer.

Either way, any of the configurations or layer structures described above falls within the term 'intimately coupled' as used herein and defined further above.

As used herein, the term 'susceptor' refers to an element that is capable to convert electromagnetic energy into heat when subjected to a changing electromagnetic field. This may be the result of hysteresis losses and/or eddy currents induced in the susceptor material, depending on its electrical and magnetic properties. The material and the geometry for the susceptor assembly can be chosen to provide a desired heat generation.

Preferably, the first susceptor material may also have a Curie temperature. Advantageously, the Curie temperature of the first susceptor material is distinct from, in particular higher than the Curie temperature of the second susceptor material. Accordingly, the first susceptor material may have a first Curie temperature and the second susceptor material may have a second Curie temperature. The Curie temperature is the temperature above which a ferrimagnetic or ferromagnetic material loses its ferrimagnetism or ferromagnetism, respectively, and becomes paramagnetic.

By having at least a first and a second susceptor material, with either the second susceptor material having a Curie temperature and the first susceptor material not having a Curie temperature, or first and second susceptor materials having each Curie temperatures distinct from one another, the susceptor assembly may provide multiple functionalities, such as inductive heating and controlling of the heating temperature. In particular, these functionalities may be separated due to the presence of at least two different susceptors.

Preferably, the first susceptor material is configured for heating the aerosol-forming substrate. For this, the first susceptor material may be optimized with regard to heat loss and thus heating efficiency. The first susceptor material may have a Curie temperature in excess of 400° C.

Preferably, the first susceptor material is made of an anti-corrosive material. Thus, the first susceptor material is advantageously resistant to any corrosive influences, in particular in case the susceptor assembly is embedded in an aerosol-generating article in direct physical contact with aerosol-forming substrate.

The first susceptor material may comprise a ferromagnetic metal. In that case, heat cannot only by generated by eddy currents, but also by hysteresis losses. Preferably the first susceptor material comprises iron (Fe) or an iron alloy such as steel, or an iron nickel alloy. In particular, the first susceptor material may comprise stainless steel, for example ferritic stainless steel. It may be particularly preferred that the first susceptor material comprises a 400 series stainless steel such as grade 410 stainless steel, or grade 420 stainless steel, or grade 430 stainless steel, or stainless steel of similar grades.

The first susceptor material may alternatively comprise a suitable non-magnetic, in particular paramagnetic, conductive material, such as aluminum (Al). In a paramagnetic conductive material inductive heating occurs solely by resistive heating due to eddy currents.

Alternatively, the first susceptor material may comprise a non-conductive ferrimagnetic material, such as a non-conductive ferrimagnetic ceramic. In that case, heat is only by generated by hysteresis losses.

In contrast, the second susceptor material may be optimized and configured for monitoring a temperature of the susceptor assembly. The second susceptor material may be selected to have a Curie temperature which essentially corresponds to a predefined maximum heating temperature of the first susceptor material. The maximum desired heating temperature may be defined to be approximately the temperature that the susceptor assembly should be heated to in order to generate an aerosol from the aerosol-forming substrate. However, the maximum desired heating temperature should be low enough to avoid local overheating or burning of the aerosol-forming substrate. Preferably, the Curie temperature of the second susceptor material should be below an ignition point of the aerosol-forming substrate. The second susceptor material is selected for having a detectable Curie temperature below 500° C., preferably equal to or below 400° C., in particular equal to or below 370° C. For example, the second susceptor may have a specified Curie temperature between 150° C. and 400° C., in particular between 200° C. and 400° C. Though the Curie temperature and the temperature marker function is the primary property of the second susceptor material, it may also contribute to the heating of the susceptor assembly.

It is preferred that the second susceptor is present as a dense layer. A dense layer has a higher magnetic permeability than a porous layer, making it easier to detect fine changes at the Curie temperature.

Preferably, the second susceptor material comprises a ferromagnetic metal such as nickel (Ni). Nickel has a Curie temperature in the range of about 354° C. to 360° C. or 627 K to 633 K, respectively, depending on the nature of impurities. A Curie temperature in this range is ideal because it is approximately the same as the temperature that the susceptor should be heated to in order to generate an aerosol from the aerosol-forming substrate, but still low enough to avoid local overheating or burning of the aerosol-forming substrate.

Alternatively, the second susceptor material may comprise a nickel alloy, in particular a Fe—Ni—Cr alloy. Advantageously, Fe—Ni—Cr alloys are anti-corrosive. As an example, the second susceptor may comprise a commercial alloy like Phytherm 230 or Phytherm 260. The Curie temperature of these Fe—Ni—Cr alloys can be customized. Phytherm 230 has a composition (in % by weight=wt %) with 50 wt % Ni, 10 wt % Cr and rest Fe. The Curie temperature of Phytherm 230 is 230° C. Phytherm 260 has a composition with 50 wt % Ni, 9 wt % Cr and rest Fe. The Curie temperature of Phytherm 260 is 260° C.

Likewise, the second susceptor material may comprise a Fe—Ni—Cu—X alloy, wherein X is one or more elements taken from Cr, Mo, Mn, Si, Al, W, Nb, V and Ti.

As regards the third layer, the stress-compensating material may include an austenitic stainless steel. For example, the third layer may include X5CrNi18-10 (according to EN (European Standards) nomenclature, material number 1.4301, also known as V2A steel) or X2CrNiMo17-12-2 (according to EN (European Standards) nomenclature, material number 1.4571 or 1.4404, also known as V4A steel). Austenitic stainless steel is preferably used in case the first susceptor material comprises a ferritic stainless steel and the second susceptor material comprises nickel because austenitic stainless steel has a larger coefficient of thermal expansion than nickel which in turn has a larger coefficient of thermal expansion than ferritic stainless steel. Furthermore, due to its paramagnetic characteristics and high electrical resistance, austenitic stainless steel only weakly shields the second susceptor material from the electromagnetic field to be applied to the first and second susceptors.

The layer thickness of the third layer may be in a range of 0.5 to 1.5, in particular 0.75 to 1.25, times a layer thickness of the first layer. A layer thickness of the third layer within these ranges may prove advantageous for counteracting or even compensating a compressive or tensile stress exerted by the first layer onto the second layer. Preferably the layer thickness of the third layer is equal to a layer thickness of the first layer.

As used herein, the term 'thickness' refers to dimensions extending between the top and the bottom side, for example between a top side and a bottom side of a layer or a top side and a bottom side of the multilayer susceptor assembly. The term 'width' is used herein to refer to dimensions extending between two opposed lateral sides. The term 'length' is used herein to refer to dimensions extending between the front and the back or between other two opposed sides orthogonal to the two opposed lateral sides forming the width. Thickness, width and length may be orthogonal to each other.

The multilayer susceptor assembly may be an elongated susceptor assembly having a length of between 5 mm and 15 mm, a width of between 3 mm and 6 mm and a thickness of between 10 μm and 500 μm. As an example, the multilayer susceptor assembly may be an elongated strip, having a first layer which is a strip of 430 grade stainless steel having a length of 12 mm, a width of between 4 mm and 5 mm, for example 4 mm, and a thickness of between 10 μm and 50 μm, such as for example 25 μm. The grade 430 stainless steel may be coated with a second layer of nickel as second susceptor material having a thickness of between 5 μm and 30 μm, for example 10 μm. On top of the second layer, opposite to the first layer, a third layer may be coated which is made of an austenitic stainless steel.

The susceptor assembly according to the present invention may be preferably configured to be driven by an alternating, in particular high-frequency electromagnetic field. As referred to herein, the high-frequency electromagnetic field may be in the range between 500 kHz to 30 MHz, in particular between 5 MHz to 15 MHz, preferably between 5 MHz and 10 MHz.

The susceptor assembly preferably is a susceptor assembly of an aerosol-generating article for inductively heating an aerosol-forming substrate which is part of the aerosol-generating article.

According to the invention there is also provided an aerosol-generating article comprising an aerosol-forming substrate and a susceptor assembly according to the present invention and as described herein for inductively heating the substrate.

Preferably, the susceptor assembly is located or embedded in the aerosol-forming substrate.

As used herein, the term 'aerosol-forming substrate' relates to a substrate capable of releasing volatile compounds that can form an aerosol upon heating the aerosol-forming substrate. The aerosol-forming substrate may conveniently be part of an aerosol-generating article. The aerosol-forming substrate may be a solid or a liquid aerosol-forming substrate. In both cases, the aerosol-forming substrate may comprise both solid and liquid components. The aerosol-forming substrate may comprise a tobacco-containing material containing volatile tobacco flavour compounds, which are released from the substrate upon heating. Alternatively or additionally, the aerosol-forming substrate may comprise a non-tobacco material. The aerosol-forming substrate may further comprise an aerosol former. Examples of suitable aerosol formers are glycerine and propylene glycol. The aerosol-forming substrate may also comprise other additives and ingredients, such as nicotine or flavourants. The aerosol-forming substrate may also be a paste-like material, a sachet of porous material comprising aerosol-forming substrate, or, for example, loose tobacco mixed with a gelling agent or sticky agent, which could include a common aerosol former such as glycerine, and which is compressed or molded into a plug.

The aerosol-generating article is preferably designed to engage with an electrically-operated aerosol-generating device comprising an induction source. The induction source, or inductor, generates a fluctuating electromagnetic field for heating the susceptor assembly of the aerosol-generating article when located within the fluctuating electromagnetic field. In use, the aerosol-generating article engages with the aerosol-generating device such that the susceptor assembly is located within the fluctuating electromagnetic field generated by the inductor.

Further features and advantages of the aerosol-generating article according to the present invention have been described with regard to susceptor assembly and will not be repeated.

BRIEF DESCRIPTION OF THE DRAWINGS

The invention will be further described, by way of example only, with reference to the accompanying drawings, in which.

BRIEF DESCRIPTION OF THE DRAWINGS

Figure 1:
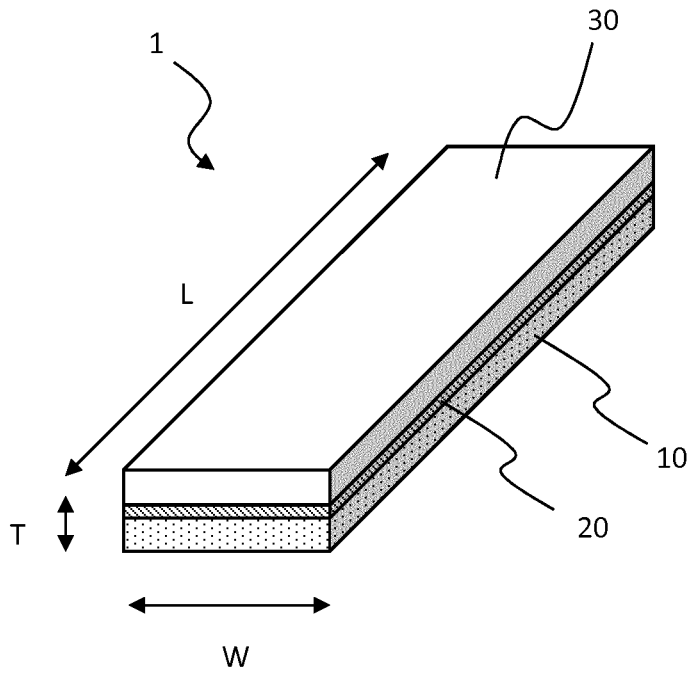
FIG. 1 shows a schematic perspective illustration of an exemplary embodiment of a multilayer susceptor assembly according to the invention.
Figure 2:
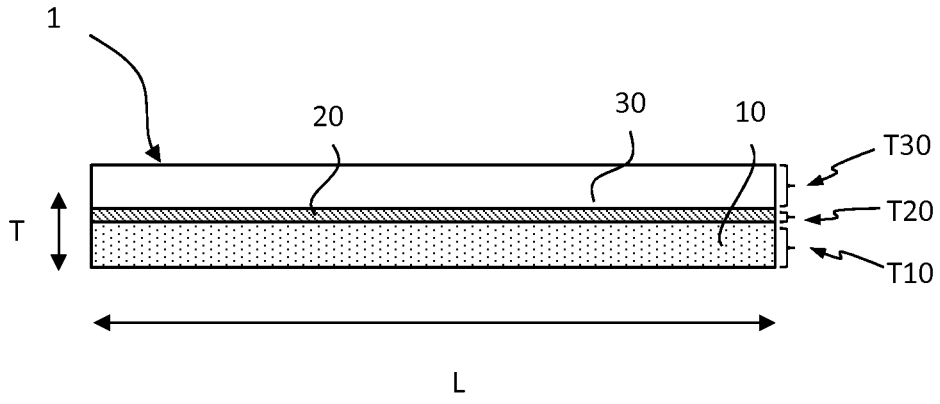
FIG. 2 shows a schematic side-view illustration of the susceptor assembly according to FIG. 1.

FIG. 1 and FIG. 2 schematically illustrate an exemplary embodiment of a susceptor assembly 1 according to the present invention that is configured for inductively heating an aerosol-forming substrate. As will be explained below in more detail with regard to FIG. 3, the susceptor assembly 1 is preferably configured to be embedded in an aerosol-generating article, in direct contact with the aerosol-forming substrate to be heated. The article itself is adapted to be received within an aerosol-generating device which comprises an induction source configured for generating an alternating, in particular high-frequency electromagnetic field. The fluctuating field generates eddy currents and/or hysteresis losses within the susceptor assembly 1 causing it to heat up. The arrangement of the susceptor assembly 1 in the aerosol-generating article and the arrangement of the aerosol-generating article in the aerosol-generating device are such that the susceptor assembly 1 is accurately positioned within the fluctuating electromagnetic field generated by the induction source.

The susceptor assembly 1 according to the embodiment shown in FIG. 1 and FIG. 2 is a three-layer susceptor assembly 1. The assembly comprises a first layer 10 as base layer comprising a first susceptor material. The first layer 10, that is, the first susceptor material is optimized with regard to heat loss and thus heating efficiency. In the present embodiment, the first layer 10 comprises ferromagnetic stainless steel having a Curie temperature in excess of 400° C. For controlling the heating temperature, the susceptor assembly 1 comprises a second layer 20 as intermediate or functional layer being arranged upon and intimately coupled to the first layer. The second layer 20 comprises a second susceptor material. In the present embodiment, the second susceptor material is nickel having a Curie temperature of in the range of about 354° C. to 360° C. or 627 K to 633 K, respectively (depending on the nature of impurities). This Curie temperature proves advantageous with regard to both, temperature control and controlled heating of aerosol-forming substrate. Once during heating the susceptor assembly 1 reaches the Curie temperature of nickel, the magnetic properties of the second susceptor material change from ferromagnetic to paramagnetic, accompanied by a temporary change of its electrical resistance. Thus, by monitoring a corresponding change of the electrical current absorbed by the induction source it can be detected when the second susceptor material has reached its Curie temperature and, thus, when the predefined heating temperature has been reached.

However, the fact that the first and second layers 10, 20 are intimately coupled to each other may influence the change of the electrical resistance of the second susceptor material. This is mainly due to specific differences between the thermal expansion of the first and second susceptor materials as will be explained in the following. During processing of the susceptor assembly 1, the first and second layer 10, 20 are connected to each other at a given temperature, typically followed by a heat treatment, such as annealing. During a subsequent change of temperature, such as during a cooldown of the susceptor assembly 1, the individual layers 10, 20 cannot deform freely due to the conjoined nature of the assembly 1. Consequently, as the nickel material within the second layer 20 has a coefficient of thermal expansion larger than that one of the stainless steel within the first layer 10, a tensile stress state may develop in the second layer 20 upon cooldown. This tensile stress state in turn may reduce the magnetic susceptibility of nickel material due to magnetostriction because nickel has a negative coefficient of magnetostriction. In particular in the relevant temperature range around the Curie temperature of the nickel material, the reduced magnetic susceptibility may cause a change of the skin layer depth and, thus, a temporary change of the electrical resistance of the nickel material to be less pronounced. This in turn may undesirably impair the functionality of the second layer as temperature marker.

In order to counteract the undesired tensile stress exerted by the first layer 10 onto the second layer 20, the susceptor assembly 1 according to the present invention further comprises a third layer 30 that is intimately coupled to the second layer 20. The third layer comprises a specific stress-compensating material and a specific layer thickness T30 which is specifically chosen such that after a processing of the multi-layer susceptor assembly 1, for example after a heat treatment, the third layer 30 exerts a specific compressive stress onto the second layer 20 at least in a certain compensation temperature range. The compensation temperature range extends at least from 20 K below the Curie temperature of nickel up to the Curie temperature of nickel. Accordingly, the third layer 30 advantageously allows for preserving the originally desired properties and functionalities of the second layer 20.

In the present embodiment, the third layer comprises an austenitic stainless steel as stress-compensating material, for example V2a or V24 steel. Advantageously, austenitic stainless steel has a larger coefficient of thermal expansion larger than the nickel material of the second layer 20 and the ferromagnetic stainless steel of the first layer 10. Furthermore, due to its paramagnetic characteristics and high electrical resistance, austenitic stainless steel only weakly shields the nickel material of the second layer 20 from the electromagnetic field to be applied thereto.

With regard to the embodiment shown in FIG. 1 and FIG. 2, the susceptor assembly 1 is in the form of an elongate strip having a length L of 12 mm and a width W of 4 mm. All layers have a length L of 12 mm and a width W of 4 mm. The first layer 10 is a strip of grade 430 stainless steel having a thickness T10 of 35 μm. The second layer 20 is a strip of nickel having a thickness T20 of 10 μm. The layer 30 is a strip of austenitic stainless steel having a thickness T30 of 35 μm. The total thickness T of the susceptor assembly 1 is 80 μm. The susceptor assembly 1 is formed by cladding the strip of nickel 20 to the strip of stainless steel 10. After that, the austenitic stainless steel strip 30 is cladded on top of the nickel strip 20.

As the first and third layer 10, 30 are made of stainless steel, they advantageously provide an anti-corrosion covering for the nickel material in the second layer 20.

Figure 3:
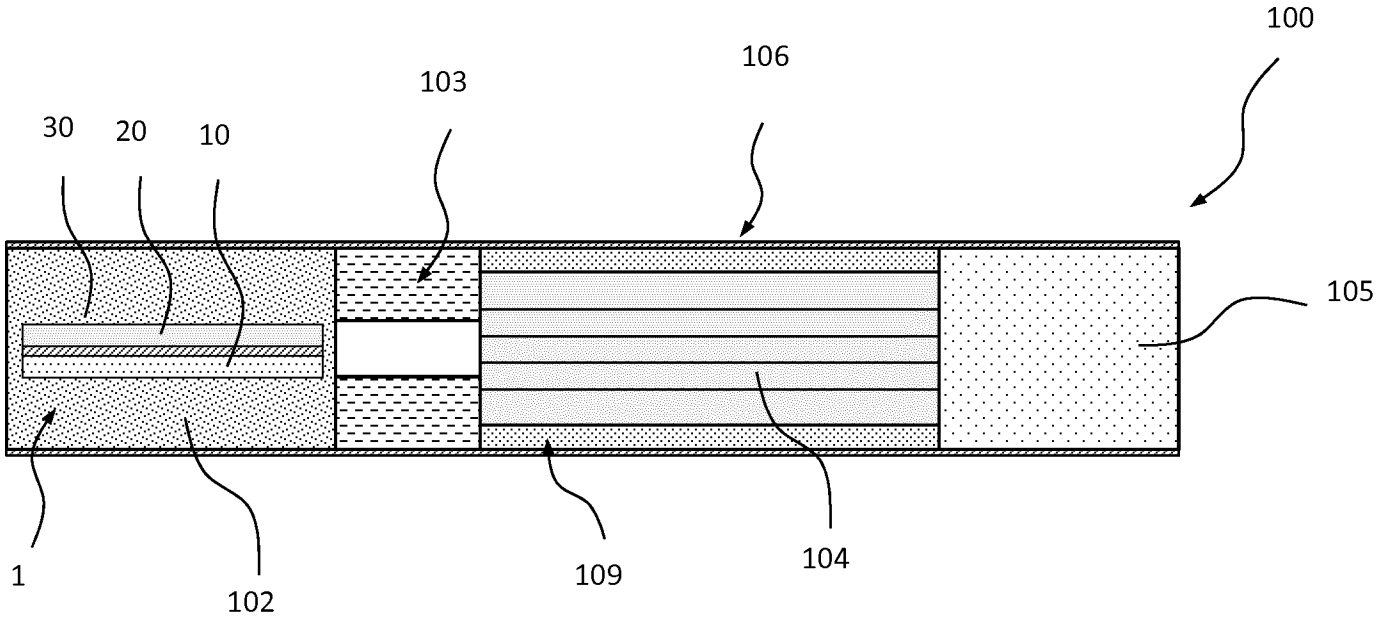
FIG. 3 shows a schematic cross-sectional illustration of an exemplary embodiment of an aerosol-generating article according to the invention.

FIG. 3 schematically illustrates an exemplary embodiment of an aerosol-generating article 100 according to the invention. The aerosol-generating article 100 comprises four elements arranged in coaxial alignment: an aerosol-forming substrate 102, a support element 103, an aerosol-cooling element 104, and a mouthpiece 105. Each of these four elements is a substantially cylindrical element, each having substantially the same diameter. These four elements are arranged sequentially and are circumscribed by an outer wrapper 106 to form a cylindrical rod. Further details of this specific aerosol-generating article, in particular of the four elements, are disclosed in WO 2015/176898 A1.

An elongate susceptor assembly 1 is located within the aerosol-forming substrate 102, in contact with the aerosol-forming substrate 102. The susceptor assembly 1 as shown in FIG. 3 corresponds to the susceptor assembly 1 according to FIGS. 1 and 2. The layer structure of the susceptor assembly as shown in FIG. 3 is illustrated oversized, but not true to scale with regard to the other elements of the aerosol-generating article. The susceptor assembly 1 has a length that is approximately the same as the length of the aerosol-forming substrate 102, and is located along a radially central axis of the aerosol-forming substrate 102. The aerosol-forming substrate 102 comprises a gathered sheet of crimped homogenized tobacco material circumscribed by a wrapper. The crimped sheet of homogenized tobacco material comprises glycerin as an aerosol-former.

The susceptor assembly 1 may be inserted into the aerosol-forming substrate 102 during the process used to form the aerosol-forming substrate, prior to the assembly of the plurality of elements to form the aerosol-generating article.

The aerosol-generating article 100 illustrated in FIG. 3 is designed to engage with an electrically-operated aerosol-generating device. The aerosol-generating device may comprise an induction source having an induction coil or inductor for generating an alternating, in particular high-frequency electromagnetic field in which the susceptor assembly of the aerosol-generating article is located in upon engaging the aerosol-generating article with the aerosol-generating device.

The invention claimed is:

1. A multi-layer susceptor assembly for inductively heating an aerosol-forming substrate, the susceptor assembly comprising at least:

a first layer comprising a first susceptor material;

a second layer intimately coupled to the first layer, comprising a second susceptor material having a Curie temperature lower than 500° C.;

a third layer intimately coupled to the second layer, comprising a specific stress-compensating material and a specific layer thickness such that after intimately coupling the layers to each other and/or after a heat treatment of the multi-layer susceptor assembly the third layer exerts a tensile or compressive stress onto the second layer at least in a compensation temperature range for counteracting a compressive or tensile stress exerted by the first layer onto the second layer, wherein the compensation temperature range extends at least from 20 K below the Curie temperature of the second susceptor material up to the Curie temperature of the second susceptor material.

2. The susceptor assembly according to claim 1, wherein a coefficient of thermal expansion of the second susceptor material is larger than a coefficient of thermal expansion of the first susceptor material and smaller than a coefficient of thermal expansion of the stress-compensating material.

3. The susceptor assembly according to claim 1, wherein the second susceptor material has a negative coefficient of magnetostriction and wherein the specific stress-compensating material and the specific layer thickness of the third layer is such that after intimately coupling the layers to each other and/or after a heat treatment of the multi-layer susceptor assembly the third layer exerts a compressive stress onto the second layer causing the second layer to be in a net compressive stress state at least in the compensation temperature range.

4. The susceptor assembly according to claim 1, wherein a coefficient of thermal expansion of the second susceptor material is smaller than a coefficient of thermal expansion of the first susceptor material and larger than a coefficient of thermal expansion of the stress-compensating material.

5. The susceptor assembly according to claim 1, wherein the second susceptor material has a positive coefficient of magnetostriction and wherein the specific stress-compensating material and the specific layer thickness of the third layer is such that after intimately coupling the layers to each other and/or after a heat treatment of the multi-layer susceptor assembly the third layer exerts a tensile stress onto the second layer causing the second layer to be in a net tensile stress state at least in the compensation temperature range.

6. The susceptor assembly according to claim 1, wherein the specific stress-compensating material and the specific layer thickness of the third layer is such that the third layer exerts a tensile or compressive stress onto the second layer after intimately coupling the layers to each other and/or after a heat treatment of the multi-layer susceptor assembly for enhancing a change of an electrical resistance of the second susceptor material at least when the temperature of the susceptor reaches the Curie temperature of the second susceptor material.

7. The susceptor assembly according to claim 1, wherein the specific stress-compensating material and the specific layer thickness of the third layer is such that the third layer exerts a tensile or compressive stress onto the second layer after intimately coupling the layers to each other and/or after a heat treatment of the multi-layer susceptor assembly for enhancing a change of a skin depth of the second susceptor material at least when the temperature of the susceptor reaches the Curie temperature of the second susceptor material.

8. The susceptor assembly according to claim 1, wherein the specific stress-compensating material and the specific layer thickness of the third layer is such that after intimately coupling the layers to each other and/or after a heat treatment of the multi-layer susceptor assembly the third layer exerts a tensile or compressive stress onto the second layer at least in the compensation temperature range for essentially compensating a compressive or tensile stress exerted by the first layer onto the second layer.

9. The susceptor assembly according to claim 1, wherein the first susceptor material includes aluminum, iron or an iron alloy, in particular a grade 410, grade 420, or grade 430 stainless steel.

10. The susceptor assembly according to claim 1, wherein the second susceptor material includes nickel or a nickel alloy, in particular a soft Fe—Ni—Cr alloy or a Fe—Ni—Cu—X alloy, wherein X is one or more elements taken from Cr, Mo, Mn, Si, Al, W, Nb, V and Ti.

11. The susceptor assembly according to claim 1, wherein the stress-compensating material includes austenitic a stainless steel.

12. The susceptor assembly according to claim 1, wherein the layer thickness of the third layer is in a range of 0.5 to 1.5, in particular 0.75 to 1.25, times a layer thickness of the first layer, preferably the layer thickness of the third layer is equal to a layer thickness of the first layer.

13. The susceptor assembly according to claim 1, wherein the first layer, the second layer and the third layer are adjacent layers of the multilayer susceptor assembly.

14. An aerosol-generating article comprising an aerosol-forming substrate and a susceptor assembly according to claim 1.

15. The aerosol-generating article according to claim 14, wherein the susceptor assembly is located in the aerosol-forming substrate.

* * * * *